US012669314B2

(12) United States Patent
Xia

(10) Patent No.: US 12,669,314 B2
(45) Date of Patent: Jun. 30, 2026

(54) MEMORY-TYPE MECHANICAL TOY TARGET

(71) Applicant: HuizhouShi Xute Plastic Electronic Technology Co., Ltd., Huizhou (CN)

(72) Inventor: Xubin Xia, Huizhou (CN)

(73) Assignee: HuizhouShi Xute Plastic Electronic Technology Co., Ltd., Huizhou (CN)

( * ) Notice: Subject to any disclaimer, the term of this patent is extended or adjusted under 35 U.S.C. 154(b) by 299 days.

(21) Appl. No.: 18/640,630

(22) Filed: Apr. 19, 2024

(65) Prior Publication Data

US 2024/0353207 A1 Oct. 24, 2024

(30) Foreign Application Priority Data

Apr. 22, 2023 (CN) ..... 202320927930.6

(51) Int. Cl.
*F41J 5/20* (2006.01)

(52) U.S. Cl.
CPC ..... *F41J 5/205* (2013.01)

(58) Field of Classification Search
CPC ..... F41J 5/205
USPC ..... 273/387
See application file for complete search history.

(56) References Cited

U.S. PATENT DOCUMENTS

| | | | | |
|---|---|---|---|---|
| 12,264,896 | B2 * | 4/2025 | Pautler | F41G 3/2611 |
| 12,434,130 | B2 * | 10/2025 | Rigby | A63F 3/00533 |
| D1,117,482 | S * | 3/2026 | Shi | D21/337 |
| 2019/0063884 | A1 * | 2/2019 | McBride | F41J 5/10 |
| 2021/0093945 | A1 * | 4/2021 | Shoaff | A63F 9/0252 |
| 2024/0344812 | A1 * | 10/2024 | Peabody | F41J 7/04 |
| 2024/0353207 | A1 * | 10/2024 | Xia | F41J 5/205 |

OTHER PUBLICATIONS

U.S. Appl. No. 17/029,924 B2, filed Sep. 23, 2022, Hasbro Inc.
U.S. Appl. No. 29/779,506 S, filed Apr. 20, 2021, Yong Lin.

* cited by examiner

*Primary Examiner* — Allyson N Trail

(57) ABSTRACT

A memory-type mechanical toy target includes a target and multiple marking columns; the target is provided with a plurality of column holes arranged in the array, each of the column holes passes through the target and receives one of the marking columns which can slide therein, and the two ends of each of the marking columns respectively extend out thereof, before shooting, all of the marking columns on the target are protruded out of the front plate of the target with the same height, when any of the marking columns is hit by the toy bullet, it is pushed to move towards the back plate of the target until the column cap of the marking column is propped against the front plate of the target, so as to form corresponding concave, which can intuitively display the hitting point of the toy bullet and accurately mark it.

15 Claims, 10 Drawing Sheets

MEMORY-TYPE MECHANICAL TOY TARGET

TECHNICAL FIELD

The present disclosure relates to the technical field of toy targets, more particularly, to a memory-type mechanical toy target.

BACKGROUND

For the toy gun capable of shooting a bullet, the toy target can directly show the shooting result, which not only can reflect the actual control level of the operator but also can detect the main function index of the toy gun/bullet, which is broadly applied. At present, there are many kinds of toy targets sold in the market, which can be divided into two types of electronic sensing toy targets and mechanical display toy targets according to the working principle.

Take an example of an electronic sensing toy target: Chinese Utility Model CN212747524U discloses a pressure sensing type automatic target reporter, the outer surface of the buffer plate with target ring adhered with a pressure sensing plate, and the pressure sensing plate is connected with the data collecting control plate, through the display screen and another terminal device, such as the Bluetooth, stereo, etc., can display the position information of the target ring on the buffer plate where the toy bullet is shot, but the technical scheme cannot specifically mark the shooting point, and the power supply is needed, the application is limited, at the same time, the production and use cost is relatively high.

Take an example of a mechanical display toy target: Chinese utility model patent CN216115638U discloses a novel toy target, which is provided with multiple hollow holes on the target, and the hollow holes are connected with a swinging/rotating fraction plate through a connecting piece, the fraction plate swings or rotates relative to the target when subjected to impact force, so that the player can observe the shooting hit result. However the technical scheme cannot record the result in time, and there are still shortcomings in terms of visual display of effects and effective preservation of traces.

Considering that both of the above structures have certain shortcomings in practical applications, it is proposed to research and develop a memory-type mechanical toy target that can achieve intuitionistic display, accurate record, reliable use, and simple maintenance.

SUMMARY

To overcome the shortcomings of the prior art, the disclosure provides a memory-type mechanical toy target, which overcomes the defects of the existing electronic sensing toy target and mechanical display toy target to better meet the requirement of intuitionistic display and accurate recording of the target hitting result, while having high reliability and being easy to maintain.

The technical schemes of the disclosure are as follows: a memory-type mechanical toy target includes a target and multiple marking columns; the target is provided with a plurality of column holes arranged in an array, each of the column holes passes through the target; each of the column holes contains one of the marking columns which can slide therein, and the two ends of each of the marking columns respectively extend out thereof.

The two ends of each marking column are respectively provided with a column cap, and the outer diameter of the column cap is bigger than the inner diameter of the column hole.

The column cap is integrally formed with the marking column or fixedly connected at two ends of the marking column.

The marking column is provided with a hollow interior cavity.

The marking columns arranged in an array are divided into a central area, a middle area, and an edge area in turn by different colours from the centre of the target to the outside.

The target is provided with multiple through holes arranged in the array as the column holes.

The target is a hollow structure surrounded by a front plate and a back plate; the opposite sides of the front plate and the back plate are respectively provided with matched clamping columns and clamping cylinders, each of the clamping columns is inserted into one of the clamping cylinders, so as to clamp the front plate and the back plate; the front plate and the back plate are oppositely provided with multiple pairs of through holes, and each pair of the through holes forms one of the column holes.

The target is in the shape of circular, elliptical, or polygonal.

A base is arranged under the target, the base supports the target.

A lower part of the base is symmetrically provided with two supporting legs. The column hole is provided with a notch extending from a front surface of the target to a rear surface of the target, the marking column is provided with a side portion, the portion is movably arranged in the notch.

Two opposite ends of the marking column are respectively provided with a front cover and a rear cover; an outer diameter of the front cover is larger than an inner diameter of the column hole; the side portion is provided with a bulge at a position close to the front cover, when the marking column slides in the column hole until the bulge enters the notch, the bulge is in interference fit with the notch, and a friction force between the bulge and the notch can slow a moving speed of the marking column so that the front cover stops before the front surface of the target.

The rear cover is provided with an elastic plug, the elastic plug has an outer diameter in the natural state slightly larger than the inner diameter of the column hole, when passing through the column hole, the elastic plug is pressed by a wall of the column hole to shrink to have an outer diameter smaller than the inner diameter of the column hole; after extending from the column hole, the elastic plug is restored to have the outer diameter slightly greater than the inner diameter of the column hole.

The elastic plug comprises a pair of elastic plates oppositely arranged on the periphery of the rear cover, a gap is provided between the two elastic plates, two protrusions are respectively arranged on the elastic plates, and the distance between the outer edges of the two protrusions is greater than the inner diameter of the post hole.

A suspension structure is provided on the top of the target, and the suspension structure is used for suspending the target.

The beneficial effects of the disclosure are as follows: the memory-type mechanical toy target in the disclosure, before shooting, all of the marking columns on the target are protruded out of the front plate of the target with the same height to form a flat surface. When any of the marking columns on the front plate of the target is hit by the toy bullet, the marking column is pushed to move towards the back plate of the target under the impact action until the column cap of the marking column is propped against the front plate of the target. The marking column hit by the toy bullet displaces relative to other marking columns that are not hit, so as to form a corresponding concave on the flat surface, which can intuitively display the hitting point of the toy bullet and accurately mark it. After the shooting is finished, make the target parallel to the horizontal plane and with the front plate facing downwards, all the marking columns hit by the toy bullet automatically move towards the front plate of the target under the function of gravity, until the column cap thereof is propped against the back plate of the target, so that all the marking columns are realigned, forming the flat surface for next use, the maintenance is simple.

The memory-type mechanical toy target is provided with the notch in the column hole, the marking column is provided with the side portion, the side portion slides in the notch thereby preventing the marking column rotate when moving in the column hole, so it can move more far on the target, the indication is more clear.

The memory-type mechanical toy target is provided with the bulge cooperated with the notch. After the marking column is shot to move quickly towards the rear surface of the target, when the bulge enters the botch, due to the interference fit between the two, the friction force between the two can slow down the moving speed of the marking column, so that the marking column stops moving before the front surface of the target disk, thereby preventing the two from impacting, and at least reducing the impacting strength. So that the marking column can be effectively prevent from moving reversely, at least the distance that the marking column reversely moves can be reduced, so that all of the marking columns which are shot are closer to the target than the marking columns which are not shot. Thus the user can distinguish at a glance between the marking columns being shot and the marking columns not being shot.

EMBODIMENTS

Figure 1:
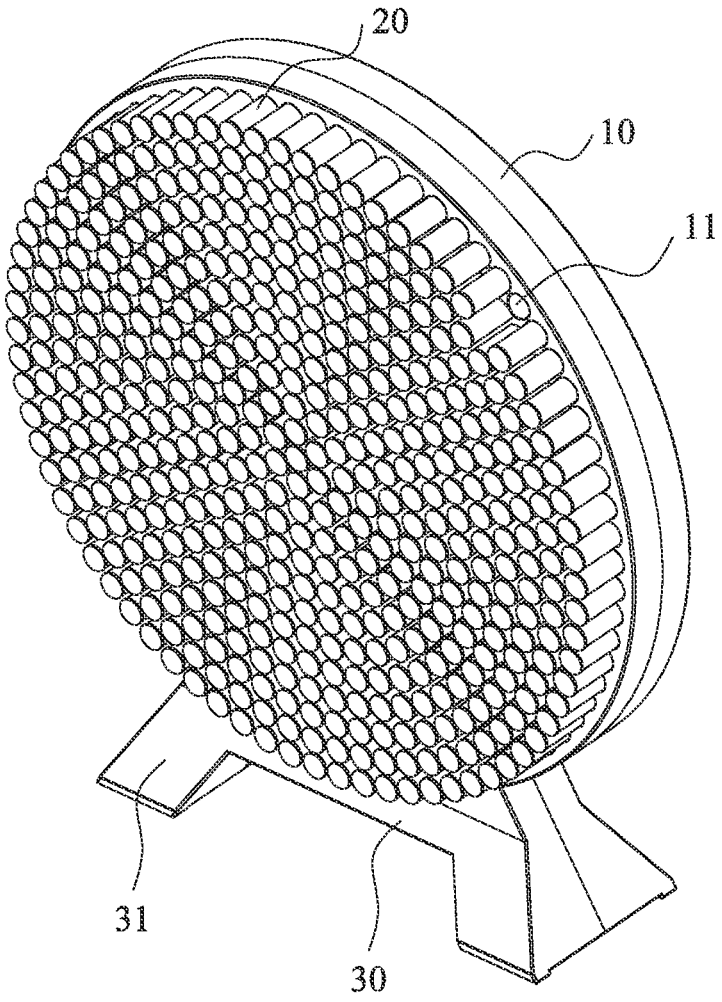
FIG. 1 is a perspective view of the memory-type mechanical toy target according to an embodiment in the disclosure.

To make the purpose, technical solution, and technical effect of the disclosure more clearly understood, the disclosure will be further described in combination with specific embodiments. It should be understood that the specific embodiments described herein are only used for explaining the disclosure, and not used for limiting the disclosure.

Referring to FIG. 1 and FIGS. 4-7, a memory-type mechanical toy target includes a target 10 and multiple marking columns 20; a plurality of column holes 11 pass through a front surface 10*a* and a rear surface 10*b* of the target 10 and arranged in the array; each of the column holes 11 contains one of the marking columns 12 which can slide therein, and the two ends of each of the marking columns 12 respectively extend out thereof. When the toy bullet is shot at the target 10, it applies an impact force to the marking column 20 contacted with it, thereby pushing the marking column 20 to slide in the column hole 11, while the marking columns 20 not contacted with the toy bullet are kept in the original position. Thus a recessed area is formed by the marking columns 20 being hit by the toy bullet on one side of the target 10 with respect to the other marking columns 20 not being hit so that the hitting point of the toy bullet can be visually displayed and accurately marked. After the shooting is finished, the hit marking columns 20 are pushed reversely to align all the marking columns 20 at the two sides of the target 10 for being used next time, and the maintenance is simple. Or Make the target plate 10 parallel to the horizontal plane with the shooting surface of the target 10 facing downward, all the marking columns 20 automatically move towards the shooting surface under the action of gravity until the column caps thereof are propped against the target 10, thus all the marking columns 20 are realigned for next use, the maintenance is simple.

The outer diameter of the marking column 20 is matched with the inner diameter of the column hole 11 so that the marking column 20 is capable of sliding in the column hole 11. Two ends of the marking column 20 are respectively provided with a column cap 21, the outer diameter of the column cap 21 is slightly greater than the inner diameter of the column hole 11. When the marking column 20 slides in the column hole 11 until the column cap 21 contacts the target 10, the column cap 21 is blocked by the target 10 from entering the column hole 11, so as to prevent the marking column 20 from separating from the column hole 11 after being impacted by the toy bullet, which keeps the integrity of the memory-type mechanical toy target and makes it durable.

The column cap 21 is integrally formed with the marking column 20 or fixedly connected at two ends of the marking column 20 by adhesive so that the marking column 20 is durable and not easy to be damaged.

Figure 5:
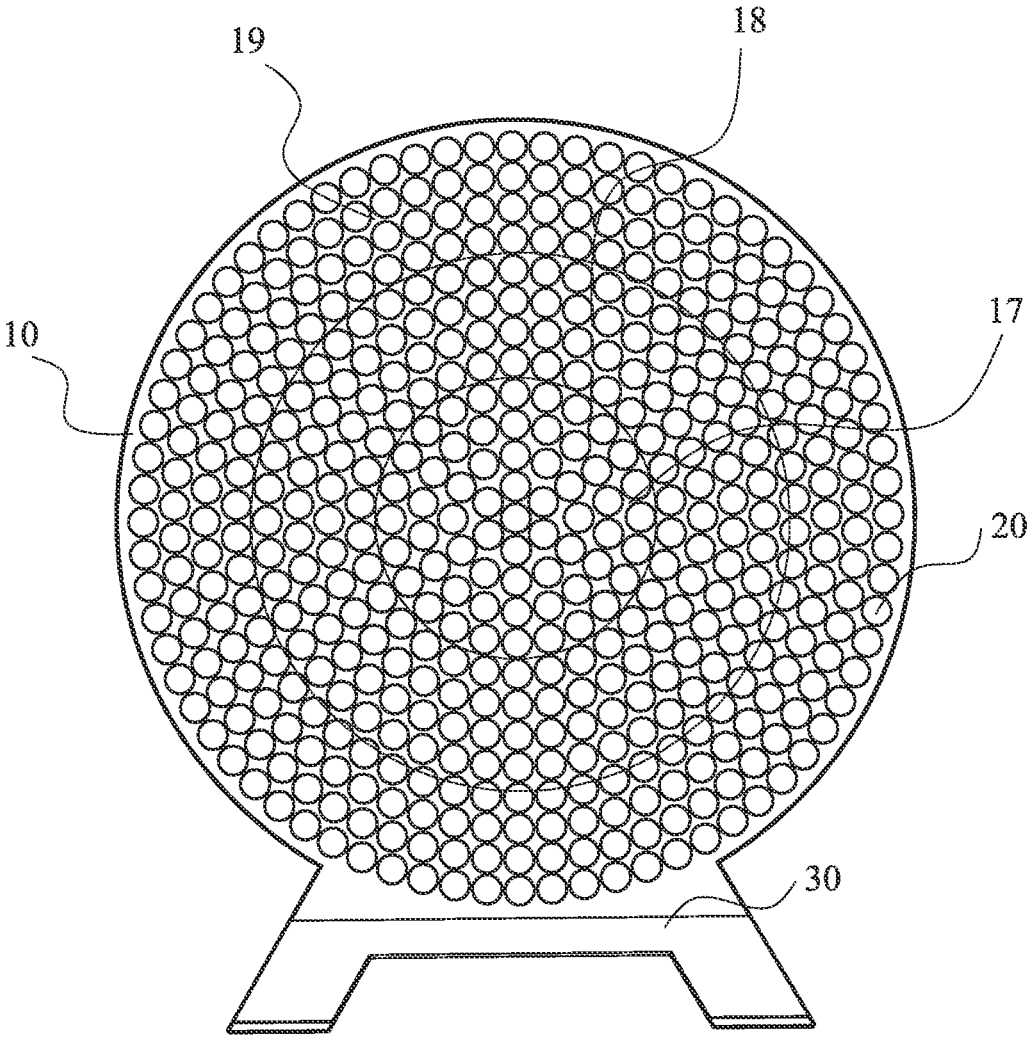
FIG. 5 is a front view of the memory-type mechanical toy target according to an embodiment in the disclosure.
Figure 6:
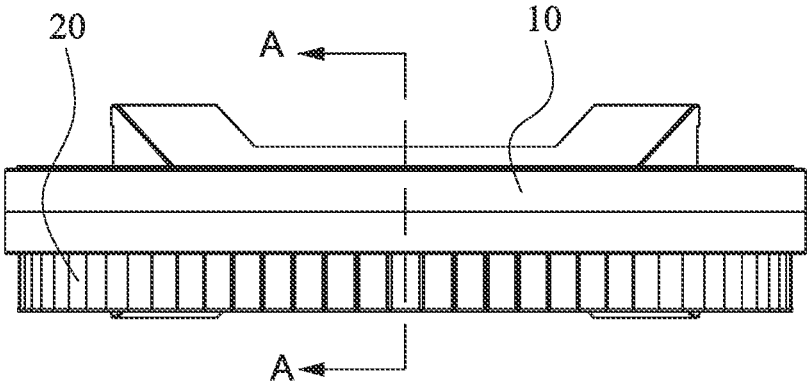
FIG. 6 is a bottom view of the memory-type mechanical toy target according to an embodiment in the disclosure.
Figure 7:
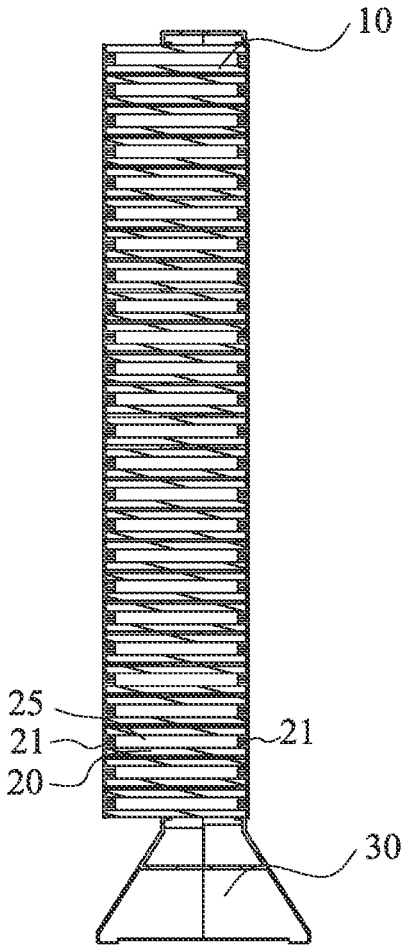
FIG. 7 is a section view along the A-A line in FIG. 6.
Figure 8:
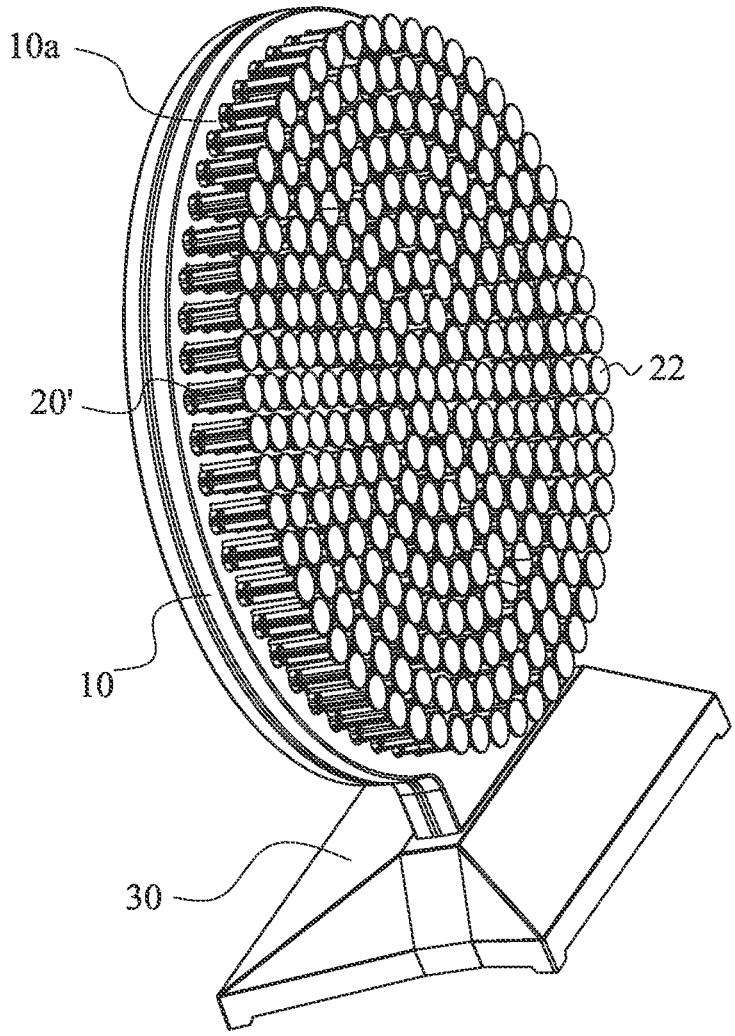
FIG. 8 is a perspective view of the memory-type mechanical toy target according to another embodiment in the disclosure.
Figure 9:
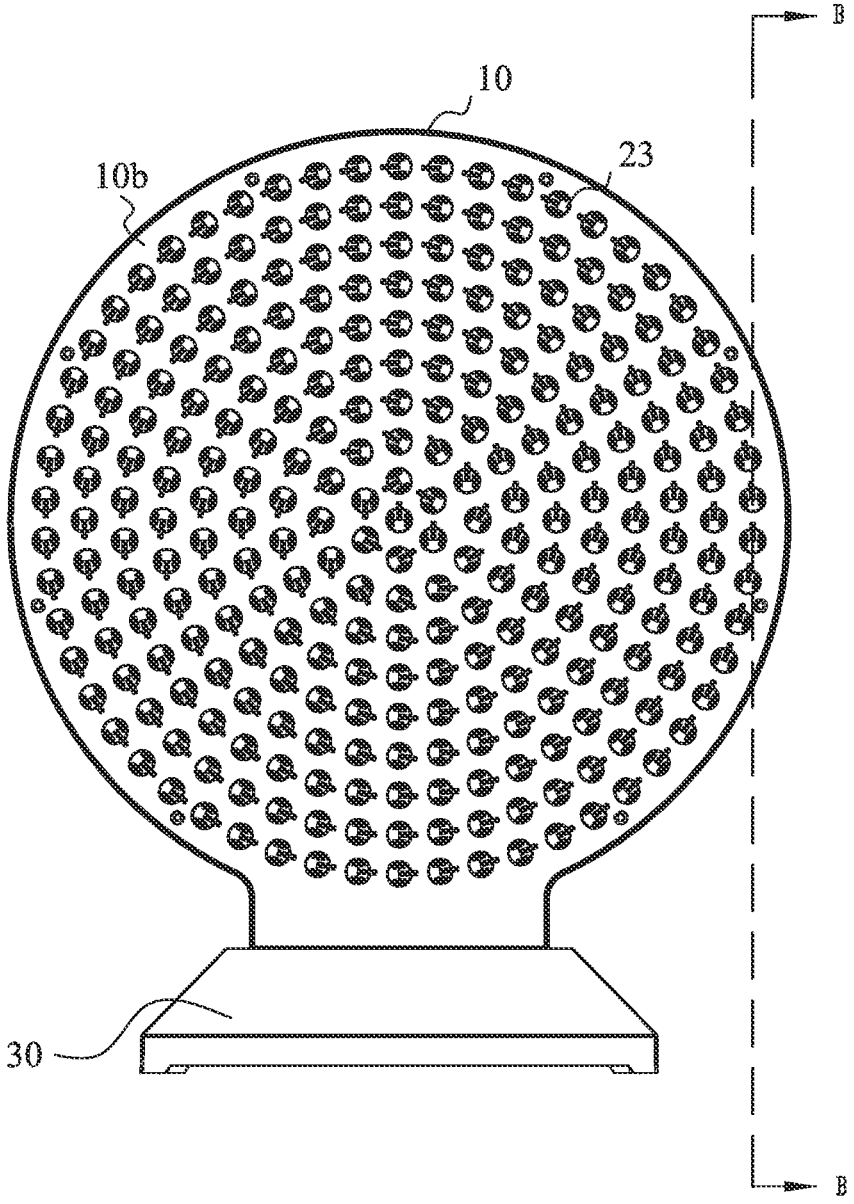
FIG. 9 is a front view of the memory-type mechanical toy target showing in FIG. 8.
Figure 10:
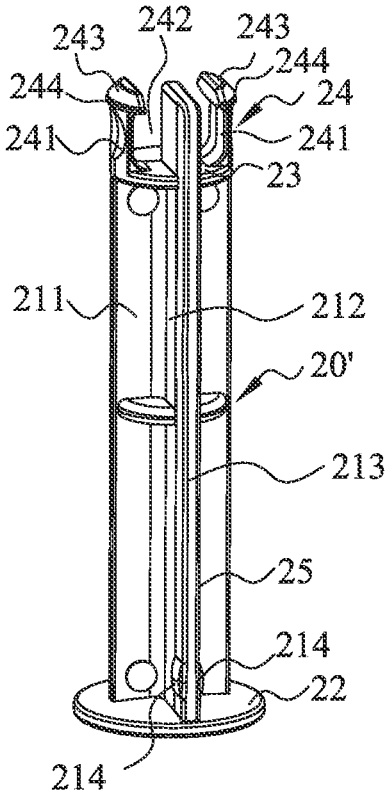
FIG. 10 is a perspective view of the marking column according to another embodiment in the disclosure.
Figure 11:
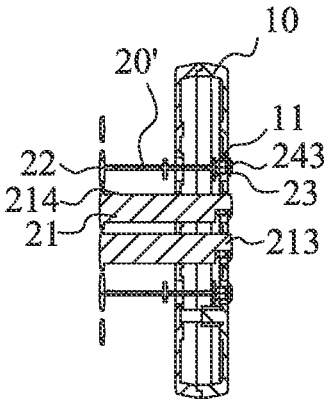
FIG. 11 is a section view along the B-B line in FIG. 9.
Figure 12:
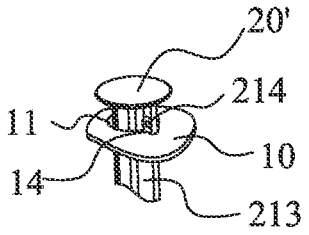
FIG. 12 is a perspective view showing the notch 14, the side portions 213 and the budge 214 in combination.
Figure 13:
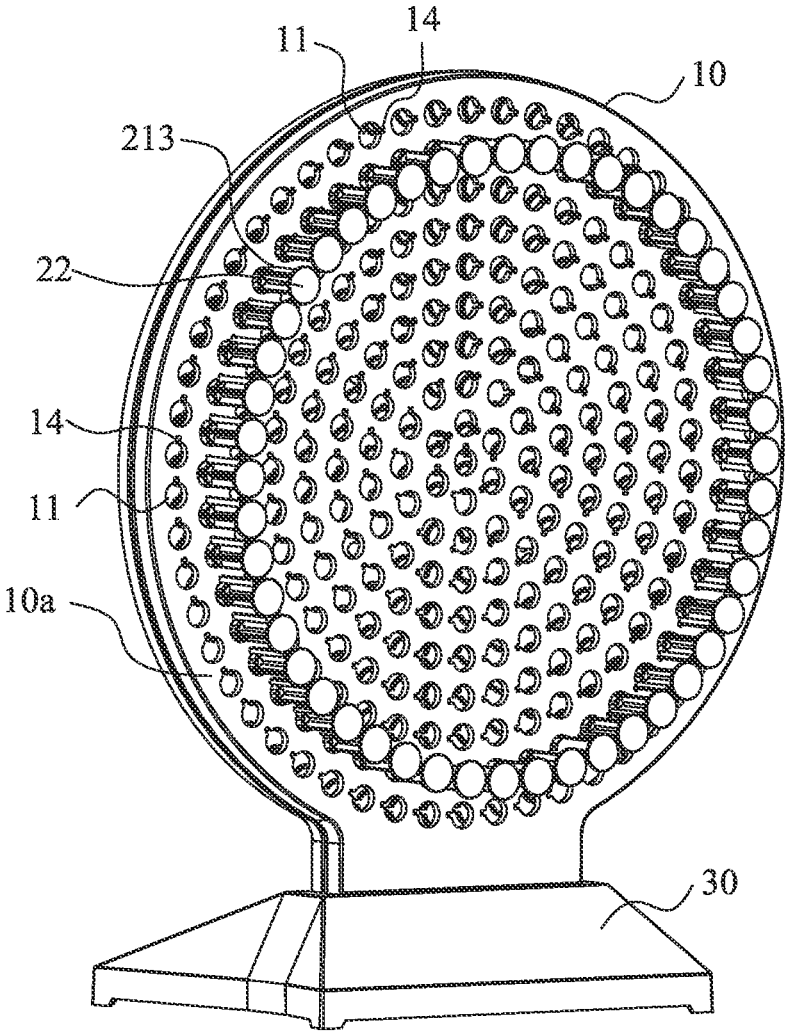
FIG. 13 is a perspective view of the memory-type mechanical toy target in the other angle according to another embodiment in the disclosure.

Referring to FIG. 5, the marking columns 20 arranged in the array are divided into a central area 22, a middle area 23, and an edge area 24 in turn by different colours from the center of the target 10 to the outside.

In an embodiment in the disclosure, the target 10 may also be a solid plate, on which a plurality of a first through holes are arranged in an array as the column holes 11.

Figure 2:
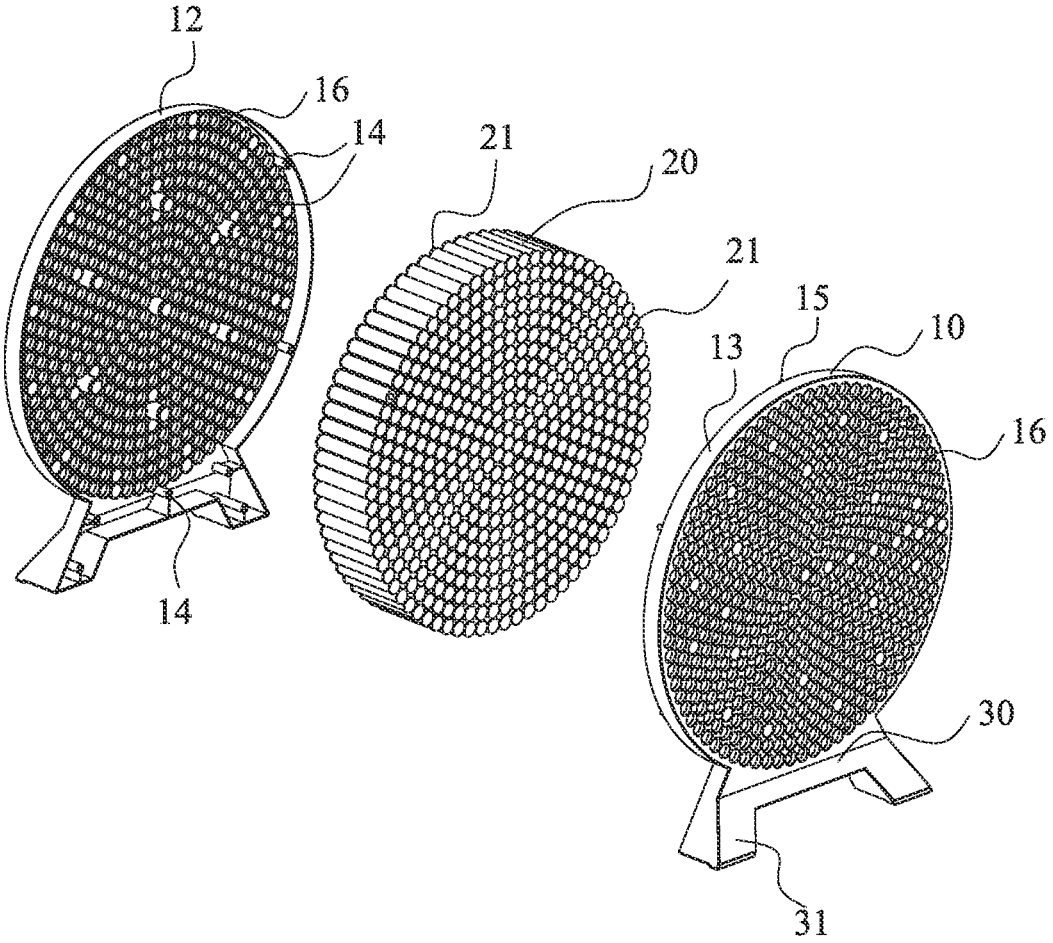
FIG. 2 is an exploded view of the memory-type mechanical toy target according to an embodiment in the disclosure.
Figure 3:
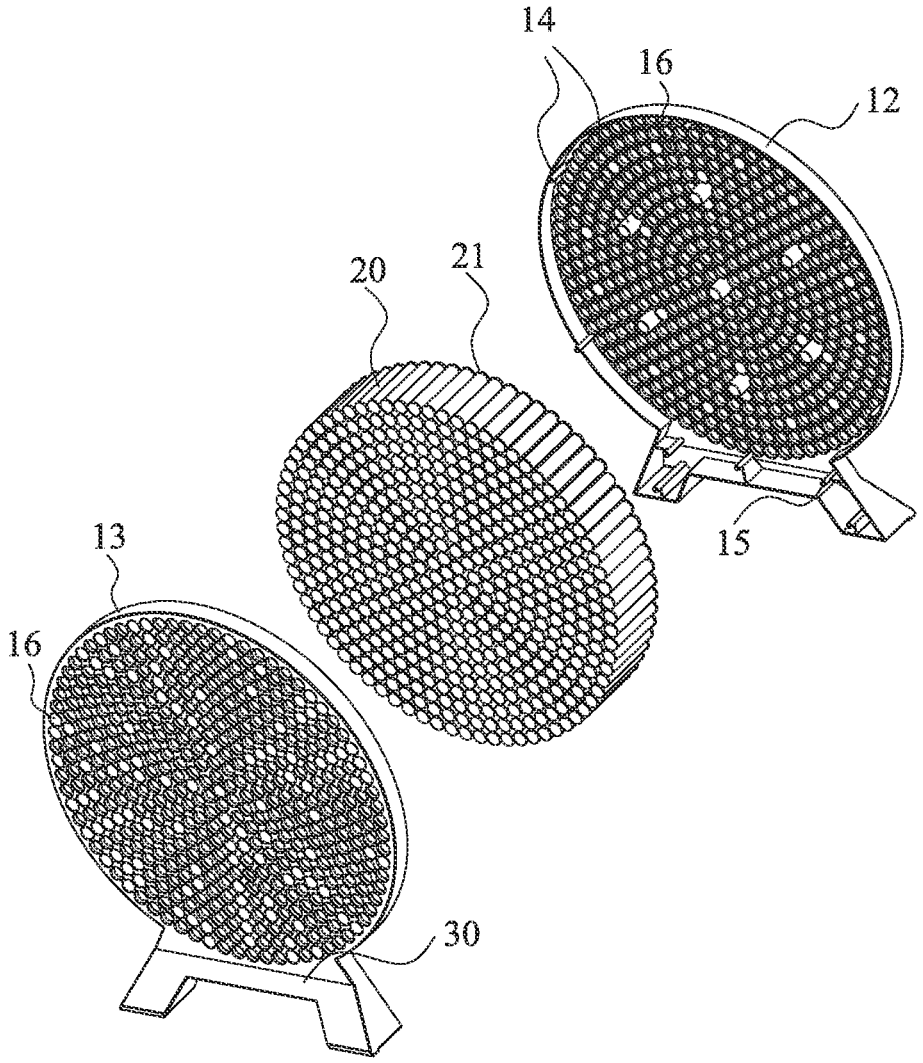
FIG. 3 is the exploded view of another angle of the memory-type mechanical toy target according to an embodiment in the disclosure.
Figure 4:
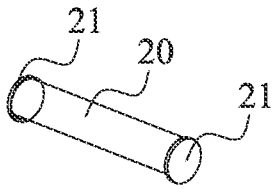
FIG. 4 is a perspective view of the marking column of the memory-type mechanical toy target according to an embodiment in the disclosure.

Referring to FIGS. 2-3, in an embodiment in the disclosure, the target 10 is a hollow structure surrounded by a front plate 12 and a back plate 13, the two are connected in a clamping manner. Specifically, the opposite sides of the front plate 12 and the back plate 13 are respectively provided with matched clamping columns 14 and clamping cylinders 15, each of the clamping columns 14 is inserted into one of the clamping cylinders 15, so as to clamp the front plate 12 and the back plate 13. The front board 12 and the back plate 13 are connected in a clamping manner, which is convenient to assemble and disassemble. It should be understood that the connection mode of the front plate 12 and the back plate 13 is not limited to the above mode, and other modes can be adopted, such as screw fixing, welding, and so on. The target 10 adopts the hollow structure, which can reduce the weight thereof, and it is convenient to carry and save material. The front plate 12 and the back plate 13 are oppositely provided with a plurality of pairs of through holes 16, and each pair of through holes 16 forms a column hole 11.

The target 10 is in shape of circular, it should be understood that the target 10 is not limited to circular, it also may be square, elliptical, polygonal, or other shapes.

In an embodiment in the disclosure, a base 30 is arranged under the target 10, the base 30 supports the target 10 to separate from the ground with a certain height to adapt to the shooting heights of different players.

A lower part of the base 30 is symmetrically provided with two supporting legs 31, so that the target 10 can be moved conveniently, and the target 10 is beautiful and elegant in appearance.

In another embodiment, the marking column 20' includes a main body 25, and two opposite ends of the main body 25 are respectively provided with a front cover 22 and a rear cover 23. The outer diameter of the front cover 22 is larger than the inner diameter of the column hole 11 so as to prevent the marking column 20 from off-target after the marking column 20 is shot and moves towards the rear surface of the target 10. The rear cover 23 is provided with an elastic plug 24. The elastic plug 24 has elasticity, and its outer diameter in the natural state is slightly larger than the inner diameter of the column hole 11, when passing through the column hole 11, the elastic plug 24 is pressed by the wall of the column hole 11 to shrink to have an outer diameter smaller than the inner diameter of the column hole 11. After extending from the column hole 11, the elastic plug 24 is restored to have an outer diameter slightly greater than the inner diameter of the column hole 11 under the action of own elastic force, thereby preventing the marking column 20' from off-target from the front surface of the target 10.

The elastic plug 24 comprises a pair of elastic plates 241 oppositely arranged on the periphery of the rear cover 23, a gap 242 is provided between the two elastic plates 241, a protrusion 243 is arranged on the top of the elastic plates 241, an outer edge 244 of the protrusion 243 protrudes out of the elastic plates 241, and the distance between the outer edges 244 of the two protrusions 242 is greater than the inner diameter of the post hole 11. When the elastic plug 24 passes through the column hole 11, the wall of the column hole 11 compresses the two plugs 242, so that the two elastic plates 241 are close to each other, and the distance between the outer edges 244 of the two plugs 242 is smaller than the inner diameter of the column hole 11, thereby being able to pass through the column hole 11. After extending from the column hole 11, the two plugs 242 restore to the outer diameter slightly greater than the inner diameter of the column hole 11 under the effect of the elastic force of the elastic plate 241 itself, so as to prevent the marking post 20' from off-target from the front surface of the target 10.

When one of the marking columns 20' is shot, it quickly moves towards the rear surface 10*b* of the target 10, then the front cover 22 impacts the front surface 10*a* of the target 10 and suffers the reaction force of the front surface 10*a* of the target disk 10, then the marking column 20' moves reversely, evenly resets to the position when it not be shot. In order to solve this defect, the inner wall of the column hole 11 is provided with a notch 14 extending from the front surface 10*a* to the rear surface 10*b* of the target disc 10. The column 21 is configured as a first plate 211 and a second plate 212 arranged in a cross shape, wherein the first plate 211 is provided with a side portion 213 protruding from the rear cover 23, and the side portion 213 extends into the notch 14, a gap is provided therebetween so that the side portion 213 can smoothly slide in the notch 14. The side portion 213 is provided with a bulge 214 at a position close to the front cover 22, and the bulge 214 is in interference fit with the notch 14. When the marking column 20' is shot and quickly moves toward the rear surface 10*a* of the target 10, the side portion 213 slides in the notch 14, and the notch 14 can prevent the marking column 20' from rotating. When the side portion 213 slides until the bulge 214 enters the notch 14, due to the interference fit between the two, the friction force between the two can slow down the moving speed of the marking column 20', so that the marking column 20' stops moving before the front surface 10*a* of the target disk 10, thereby preventing the two from impacting, and at least reducing the impacting strength. Even if impacting, due to the friction force existing between the bulge 214 and the notch 14, the marking column 20' can be effectively prevent from moving reversely, at least the distance that the marking column 20 reversely moves can be reduced, so that all of the marking columns 20' which are shot are closer to the target 10 than the marking columns 20 which are not shot. Thus the user can distinguish at a glance between the marking columns 20' being shot and the marking columns 20 not being shot.

When the bulge 214 slides out of the notch 14, the interference fit between the two is eliminated, thereby preventing long-time interference fit from causing fatigue and failing to achieve a deceleration effect.

the bulge 214 is blocked by the notch 14 due to the interference fit between them, so that the marking column 20' is retained thereon, and the marking column 20' cannot move towards the back surface of the target 10 any more. In this case, there is a certain distance between the front cover 22 and the front face of the target 10, and the front cover 22 will not be reversely moved, so that all the marking column 20' being hit appear flush on the target 10.

Figure 14:
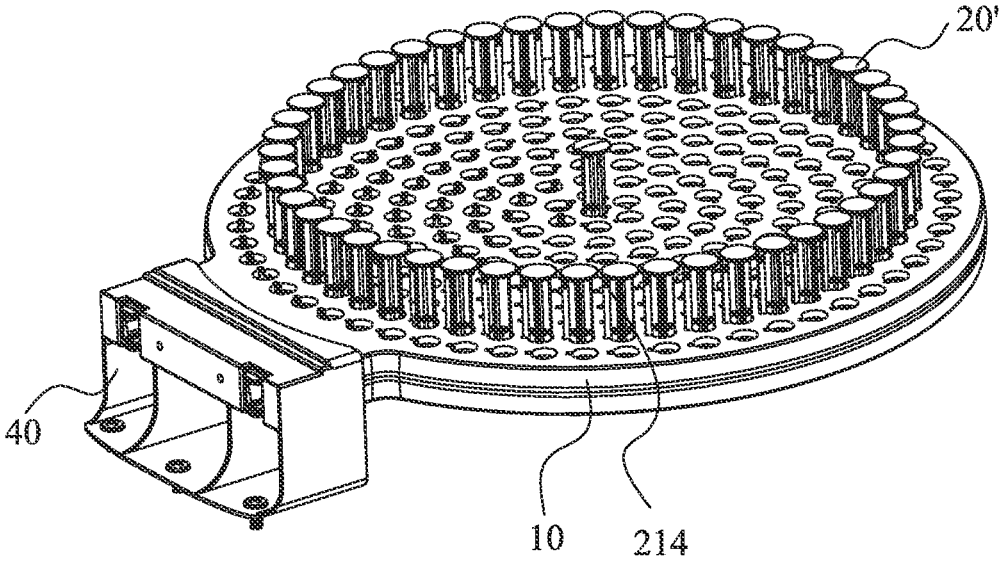
FIG. 14 is a perspective view of the memory-type mechanical toy target according to another embodiment in the disclosure.

In order to expand the usage scene of the mechanical toy target, in one embodiment of the present disclosure, the target is provided with a suspension structure 40. With reference to FIG. 14, a suspension structure 40 is provided on the top of the target 10, and the suspension structure 40 is used for suspending the toy target, for example, hanging on a wall and a house beam in the room, so that it is convenient for a user to play indoors. The suspension structure 40 is general to those skilled in the art, it is not described herein.

The above content is a further detailed description of the disclosure in combination with a specific preferred embodiment, and it can not be concluded that the specific implementation of the invention is limited to these instructions. For the general technical personnel in the technical field to which the disclosure belongs, without being separated from the conception of the disclosure, the architecture form can be flexible and changeable, and a series of products can be derived. If it is just making a number of simple deductions or substitutes should be regarded as falling within the scope of patent protection determined by the claim submitted by the disclosure.

The invention claimed is:

1. A memory-type mechanical toy target, comprising a target and multiple marking columns; said target is provided with a plurality of column holes arranged in an array, each of said column holes passes through said target; each of said column holes contains one of said marking columns which can slide therein, and two ends of each of said marking columns respectively extend out thereof.

2. The memory-type mechanical toy target according to claim 1, wherein said two ends of each marking column are respectively provided with a column cap, and an outer diameter of said column cap is bigger than an inner diameter of said column hole.

3. The memory-type mechanical toy target according to claim 2, wherein said column cap is integrally formed with said marking column or fixedly connected at said two ends of said marking column.

4. The memory-type mechanical toy target according to claim 1, wherein said marking column is provided with a hollow interior cavity.

5. The memory-type mechanical toy target according to claim 1, wherein said marking columns arranged in said array are divided into a central area, a middle area, and an edge area in turn by different colours from a center of said target to an outside.

6. The memory-type mechanical toy target according to claim 1, wherein said target is provided with multiple through holes arranged in said array as said column holes.

7. The memory-type mechanical toy target according to claim 1, wherein said target is a hollow structure surrounded by a front plate and a back plate; opposite sides of said front plate and said back plate are respectively provided with matched clamping columns and clamping cylinders, each of said clamping columns is inserted into one of said clamping cylinders to clamp said front plate and said back plate; said front plate and said back plate are oppositely provided with multiple pairs of through holes, and each pair of said through holes forms one of said column holes.

8. The memory-type mechanical toy target according to claim 1, wherein said target is in a shape of circular, elliptical, or polygonal.

9. The memory-type mechanical toy target according to claim 1, wherein a base is arranged under said target, said base supports said target.

10. The memory-type mechanical toy target according to claim 1, wherein a lower part of said base is symmetrically provided with two supporting legs.

11. The memory-type mechanical toy target according to claim 1, wherein said column hole is provided with a notch extending from a front surface of said target to a rear surface of said target, said marking column is provided with a side portion, said portion is movably arranged in said notch.

12. The memory-type mechanical toy target according to claim 11, wherein two opposite ends of said marking column are respectively provided with a front cover and a rear cover; an outer diameter of said front cover is larger than an inner diameter of said column hole; said side portion is provided with a bulge at a position close to said front cover, when said marking column slides in said column hole until said bulge enters said notch, said bulge is in interference fit with said notch, and a friction force between said bulge and said notch can slow a moving speed of said marking column so that said front cover stops before said front surface of said target.

13. The memory-type mechanical toy target according to claim 12, wherein said rear cover is provided with an elastic plug, said elastic plug has an outer diameter in a natural state slightly larger than said inner diameter of said column hole, when passing through said column hole, said elastic plug is pressed by a wall of said column hole to shrink to have an outer diameter smaller than said inner diameter of said column hole; after extending from said column hole, said elastic plug is restored to have said outer diameter slightly greater than said inner diameter of said column hole.

14. The memory-type mechanical toy target according to claim 13, wherein said elastic plug comprises a pair of elastic plates oppositely arranged on a periphery of said rear cover, a gap is provided between said two elastic plates, two protrusions are respectively arranged on said elastic plates, and a distance between outer edges of said two protrusions is greater than said inner diameter of said post hole.

15. The memory-type mechanical toy target according to claim 11, wherein a suspension structure is provided on a top of said target, and said suspension structure is used for suspending said target.

* * * * *